US007580644B2

(12) United States Patent
Murayama et al.

(10) Patent No.: US 7,580,644 B2
(45) Date of Patent: Aug. 25, 2009

(54) IMAGING FORMING DEVICE, MEDIUM, INSPECTION SYSTEM, AND RECORDING MEDIUM STORING INSPECTION PROGRAM CAPABLE OF DETERMINING CAUSE OF DEFECTIVE PRINT

(75) Inventors: Jun Murayama, Niigata (JP); Osamu Fujinawa, Niigata (JP)

(73) Assignee: Fuji Xerox Co., Ltd., Tokyo (JP)

( * ) Notice: Subject to any disclaimer, the term of this patent is extended or adjusted under 35 U.S.C. 154(b) by 233 days.

(21) Appl. No.: 11/725,437

(22) Filed: Mar. 20, 2007

(65) Prior Publication Data

US 2008/0080874 A1 Apr. 3, 2008

(30) Foreign Application Priority Data

Sep. 29, 2006 (JP) ..... 2006-267758

(51) Int. Cl.
*G03G 15/00* (2006.01)

(52) U.S. Cl. ..... 399/9

(58) Field of Classification Search ..... 399/9, 399/18, 11, 26, 31
See application file for complete search history.

(56) References Cited

U.S. PATENT DOCUMENTS

2003/0112283 A1* 6/2003 Ward et al. ..... 347/5

FOREIGN PATENT DOCUMENTS

JP 02186376 A * 7/1990
JP A 9-131908 5/1997
JP A-2006-243195 9/2006

* cited by examiner

*Primary Examiner*—Quana M Grainger
(74) *Attorney, Agent, or Firm*—Oliff & Berridge, PLC.

(57) ABSTRACT

An image forming device, which includes an inspection data storing section that stores inspection data for inspecting an inspection target for identifying a cause of a defective print, and an image forming section that forms on a medium the inspection data stored in the inspection data storing section.

26 Claims, 17 Drawing Sheets

IMAGING FORMING DEVICE, MEDIUM, INSPECTION SYSTEM, AND RECORDING MEDIUM STORING INSPECTION PROGRAM CAPABLE OF DETERMINING CAUSE OF DEFECTIVE PRINT

CROSS-REFERENCE TO RELATED APPLICATION

This application is based on and claims priority under 35 USC 119 from Japanese Patent Application No. 2006-267758 filed on Sep. 29, 2006.

BACKGROUND

1. Technical Field

The present invention relates to an image forming device, a medium, an inspection system, a recording medium storing an inspection program, and a computer data signal embodied in a carrier wave.

2. Related Art

Various techniques have been proposed for determining a cause of a defective print when the problem occurs at a printer or other image forming devices during printing.

SUMMARY

According to an aspect of the invention, there is provided an image forming device, which includes: an inspection data storing section that stores inspection data for inspecting an inspection target for identifying a cause of a defective print, and an image forming section that forms on a medium the inspection data stored in the inspection data storing section.

BRIEF DESCRIPTION OF THE DRAWINGS

Exemplary embodiments of the present invention will be described in detail based on the following figures, wherein.

DETAILED DESCRIPTION

Hereinbelow, exemplary embodiments of an image forming device, a medium, an inspection system, and a recording medium storing an inspection program, a computer data signal embodied in carrier wave, pertaining to the present invention will be described in detail with reference to the attached drawings.

FIRST EXAMPLE

Figure 1:
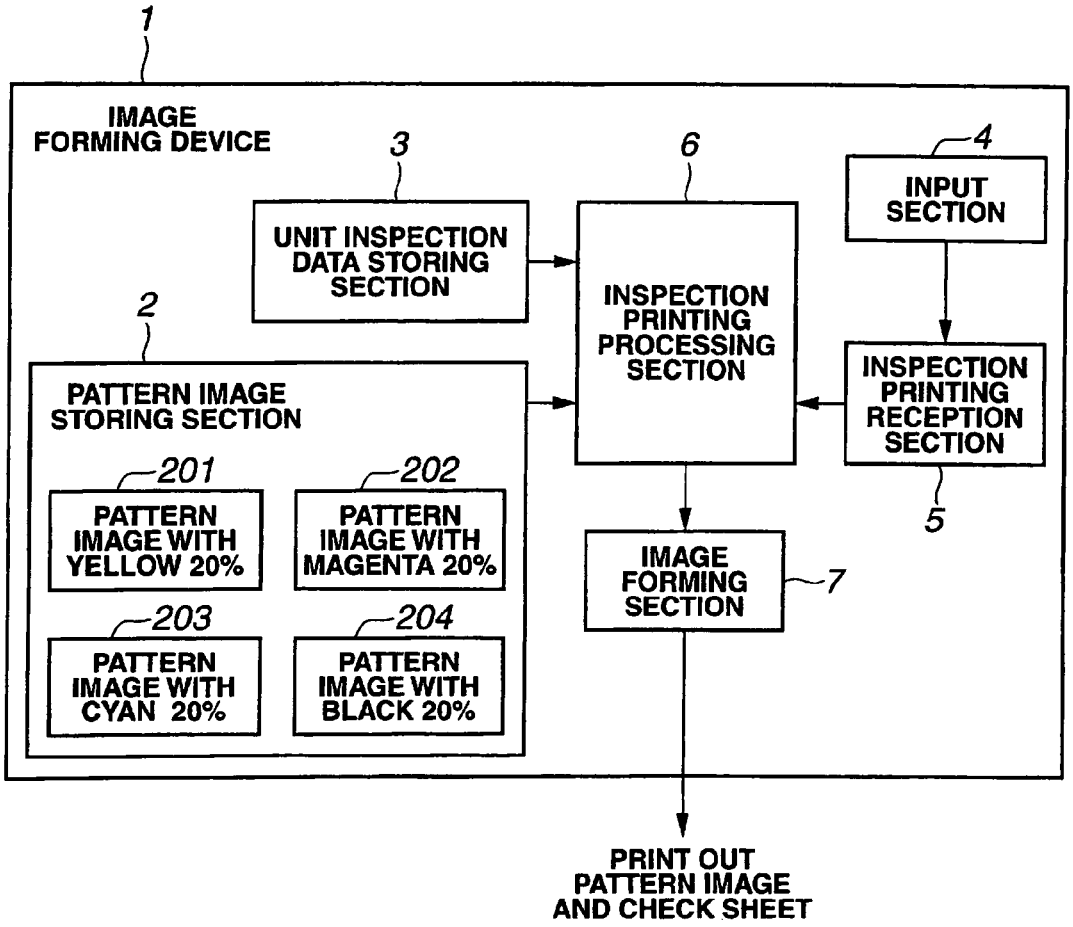
FIG. 1 is a diagram for describing the outline of the first example.

FIG. 1 is a diagram for describing the outline of the first example. With reference to FIG. 1, a functional configuration of the image forming device 1 will be described.

As shown in FIG. 1, the image forming device 1 includes a pattern image storing section 2, a unit inspection data storing section 3, an input section 4, an inspection printing reception section 5, an inspection printing processing section 6, and an image forming section 7.

The pattern image storing section 2 stores inspection target data to be inspected for identifying a cause of a defective print. Specifically, pattern images (201-204) in which a printable area is solidly colored by each of the four colors (yellow, magenta, cyan, and black) are stored as the inspection target data. Note that, in the present invention, the pattern image is formed on a sheet of paper by reducing the toner of each of the colors (i.e., low density pattern image) in order to highlight the defective print shown on the pattern images. In the first example, a pattern image 8 is formed on the sheet of paper by reducing the amount of toner, ink, etc. to 20% (i.e., density of the order of 20%), but the amount of toner, ink, etc. is not necessarily limited to 20%.

The unit inspection data storing section 3 holds the inspection data for inspecting the sheet of paper on which the pattern image is formed. Specifically, in a case when a development unit for imaging an electrostatic latent image to a photoreceptor, transformer, or other processing unit becomes malfunctioned, such malfunction has an adverse effect on the electrostatic latent image imaged to the photoreceptor, thus, during the transfer of the image from the photoreceptor to the sheet of paper, such malfunction also results in the defective print (for example, smudges, wrinkle, damage, etc.). Furthermore, since the photoreceptor rotates in the same rotational speed, the defect of printing appears in a constant interval along the processing direction. However, since the timing at which the processing unit has an effect on the photoreceptor varies according to the processing units, this constant interval also subtly varies according to the processing units. Accordingly, as the inspection data, the unit inspection data storing section stores for each of the processing units the constant intervals which vary according to the processing units.

The input section 4 is a section for inputting user's instruction to the image forming device 1. Specifically, when a defective print occurs in the image forming device 1, a user inputs into the image forming device 1 the instruction for inspection printing to determine the cause of the defect using the input section 4. Note that, in general, the input section 4 is configured by hardware such as a mouse or keyboard, or by software installed into a touch panel type display, which has a function of the input section 4.

The inspection printing reception section 5 receives the instruction for inspection printing inputted through the input section 4.

Upon receipt of the instruction for inspection printing in the inspection printing reception section 5, the inspection printing processing section 6 pulls the pattern image with yellow density of 20% 201, the pattern image with magenta density of 20% 202, the pattern image with cyan density of 20% 203 and the pattern image with black density of 20% 204 from the pattern image storing section 2, transfers them to the image forming section 7, extracts inspection data for each of the units from the units inspection data storing section 3, generates a check sheet based on the extracted inspection data (Note that the check sheet will be described in detail later.), and transfers the generated check sheet to the image forming section 7.

The image forming section 7 forms the pattern images for each of the colors transferred from the inspection printing processing section 6 and the check sheet on the sheet of paper.

Accordingly, the sheet of paper in which each of the images is formed is output (i.e. printed out) from the image forming device 1.

Note that the present invention may be applicable to a configuration in which a program (corresponding to the inspection program according to the present invention) including functions of the above-mentioned pattern image storing section 2, the unit inspection data storing section 3, the inspection printing reception section 5 and the inspection printing processing section 6 is installed into a general-purpose image forming device 1.

Note that the inspection program can be provided by being stored in a recording medium such as various types of memories or an optical disc, and can be distributed through the communication network.

Next, the description of inspection printing performed by the image forming device 1 will be made.

Figure 2:
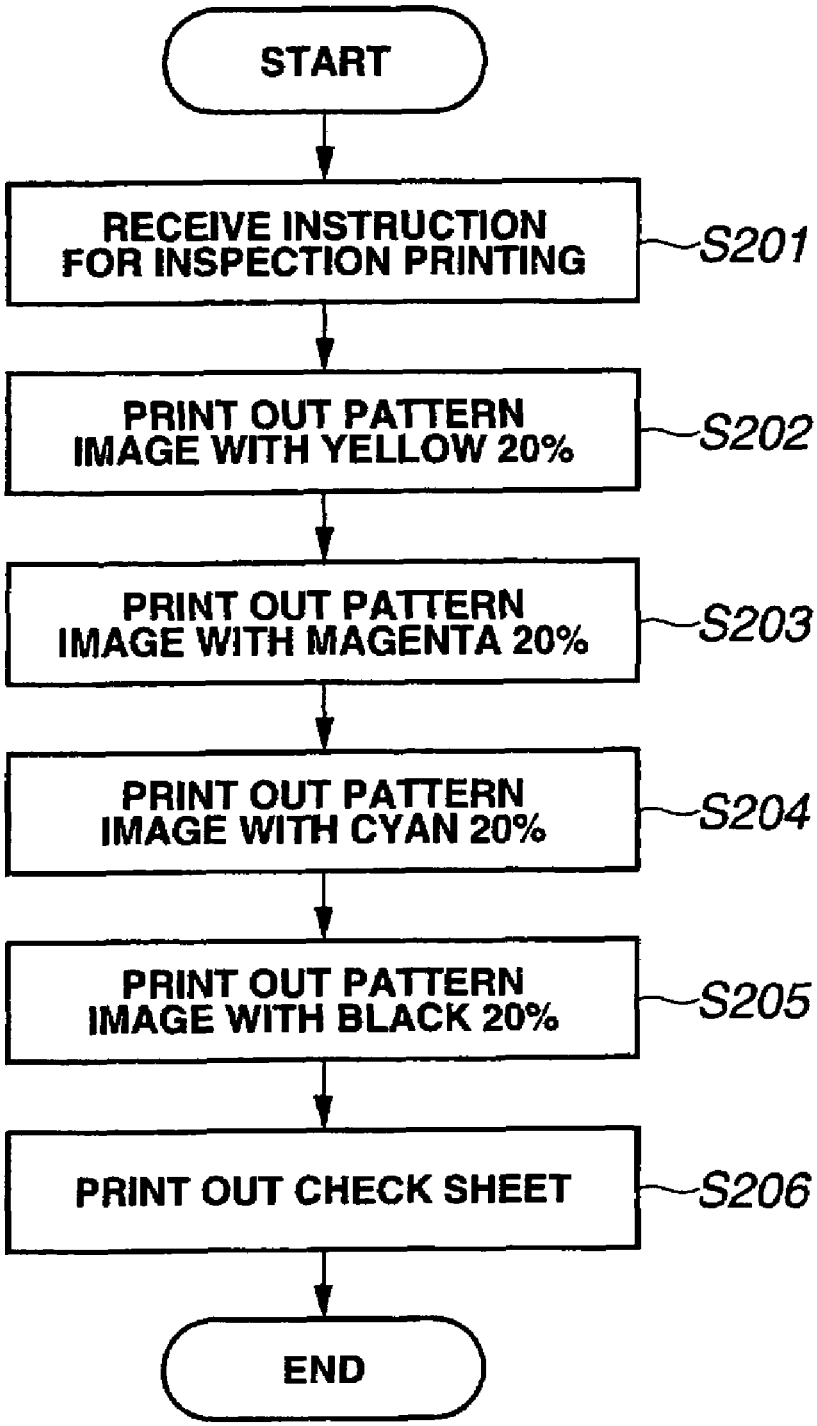
FIG. 2 is a flow chart showing a processing flow for inspection printing by an image forming device.

FIG. 2 is a flowchart showing the processing flow of the inspection printing performed by the image forming device 1.

After the inspection printing reception section receives the instruction for inspection printing (S201), the inspection printing processing section pulls the pattern image with yellow 20% from the pattern image storing section and the image forming section forms the pattern image with yellow 20% on the sheet of paper (S202), the inspection printing processing section pulls the pattern image with magenta 20% from the pattern image storing section and the image forming section forms the pattern image with magenta 20% on the sheet of paper (S203), the inspection printing processing section pulls the pattern image with cyan 20% from the pattern image storing section and forms the pattern image with cyan 20% on the sheet of paper (S204), and the inspection printing processing section pulls the pattern image with black 20% from the pattern image storing section and forms the pattern image with black 20% on the sheet of paper (S205). And the inspection printing processing section extracts inspection data for each of the units from the unit inspection data storing section, generates the check sheet, and the image forming section forms the check sheet on the sheet of paper (S206). And the inspection printing processing ends.

Next, the description of the pattern image will be made.

Figure 3A:
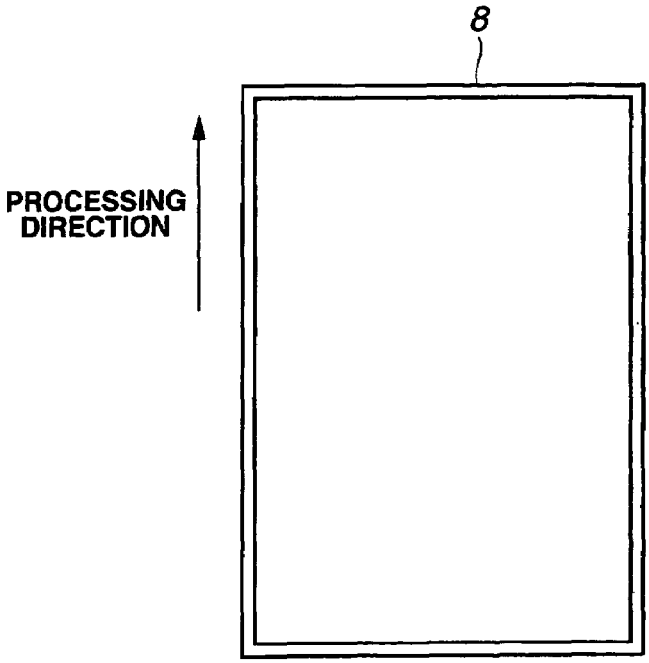
FIGS. 3A and 3B are diagrams showing examples of pattern images formed on a sheet of paper.
Figure 3B:
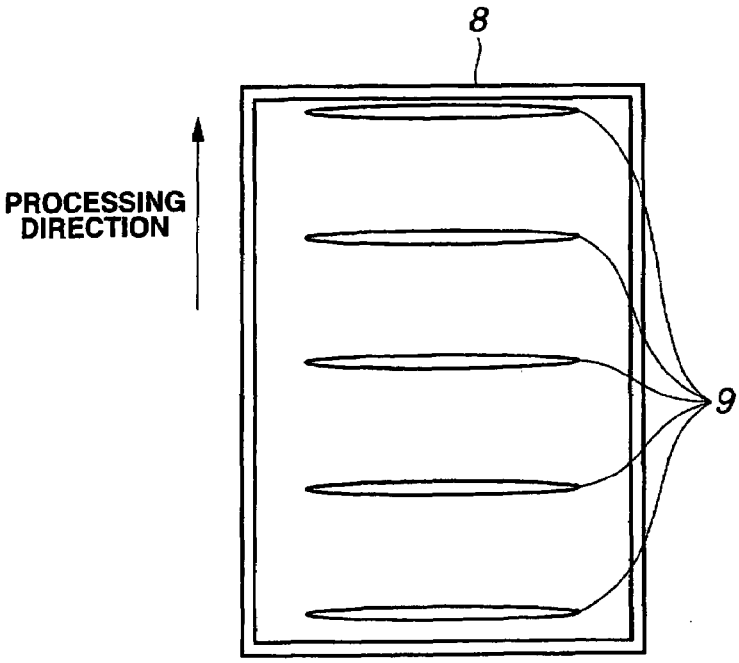

FIGS. 3A and 3B are diagrams showing an example of pattern image 8 in which an image is formed on the sheet of paper.

FIG. 3A shows the pattern image 8 in a case that the defective print does not occur. As shown in FIG. 3A, the pattern image 8 is formed within a range of printable area of the sheet of paper.

FIG. 3B shows the pattern image 8 in a case that the defective print 9 occurs. As shown in FIG. 3B, the defective prints 9 appear at certain constant intervals along the processing direction. As mentioned above, these defective prints at certain constant intervals result from the malfunction of the processing unit, and the like. In the present invention, in order to clarify the defective print 9 appearing on the pattern image 8, low density pattern image 8 (i.e., the amount of toner, ink, etc. to be applied is reduced) is formed on the sheet of paper. This is because, if high density pattern image 8 is formed, the defective print may be unclear.

Next, the description of the check sheet 10 will be made.

Figure 4:
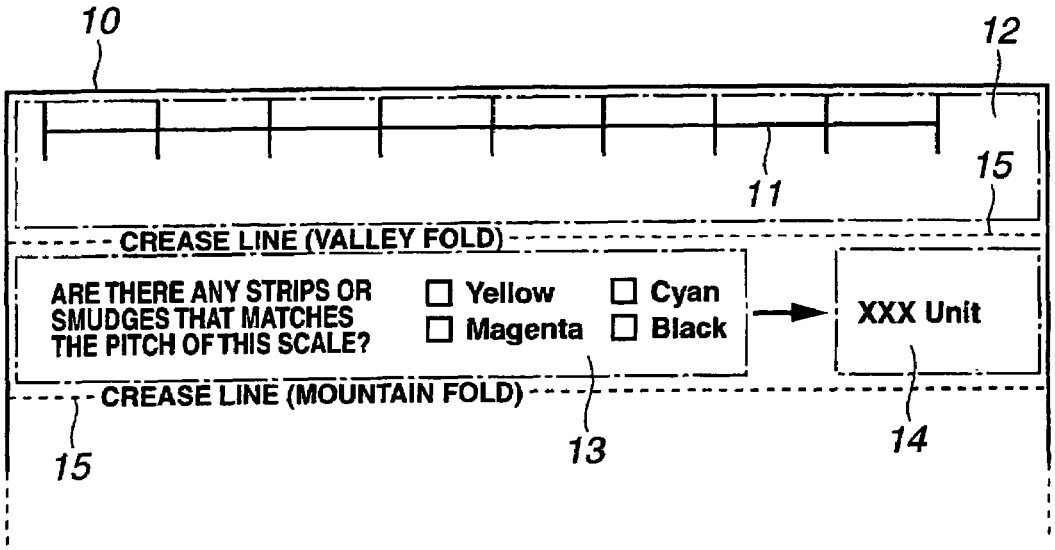
FIG. 4 is a diagram showing an example of a part of a check sheet formed on a sheet of paper.

FIG. 4 is a diagram showing an example of a part of the check sheet 10 in which an image is formed on the sheet of paper.

As shown in FIG. 4, the check sheet 10 includes a scale printing area 12 where a cause identifying standard (hereinafter referred to as "scale") 11 formed at the constant intervals stored for each of the processing units is printed, a cause identifying method printing area 13 where a cause identifying method using the scale 11 and a check list for checking which color of pattern image the scale 11 is applied to are printed, and a unit information printing area 14 where information regarding the unit of which the defective print appears at the constant intervals (for example, unit name, etc.) is printed. The area including the scale printing area 12, the cause identifying method printing area 13, and the unit information printing area 14 are printed for each of the processing unit. Note that the scale printing area 12, the cause identifying method printing area 13, and the unit information printing area 14 are printed out not necessarily for each of the processing units. By forming groups of processing units, those areas can be also printed for each of the groups. Although the constant intervals, corresponding to the inspection data, vary according to each of the processing units, the variation of each of the inspection data may be small. Thus, by forming a scale corresponding to a group of processing units with similar inspection data and printing out the scale, it can be identified which group of processing units the defective print occurs.

In the above-mentioned example in FIG. 4, the scale printing area 12 is arranged in the upper half, and the cause identifying method printing area 13 and the unit information printing area 14 are arranged in the lower half. Note that in the cause identifying method printing area 13 a specific cause identifying method of "Are there any strips or smudges that matches the pitch of this scale?" and check lists for each of the colors (yellow, magenta, cyan and black) are printed. In the unit information printing area 14, a specific unit name of "XXX Unit" is printed. At the boundary between the upper and the lower half area, information indicating the boundary (hereinafter referred to as "crease line") 15 and the guide for folding (valley fold) on the crease line 15 are printed.

In a lower part of the lower area, the area of other processing unit is printed. And in the boundary between each of the areas of the processing units, the crease line 15 and the guide to fold on the crease line 15 (mountain fold) are printed.

Figure 5:
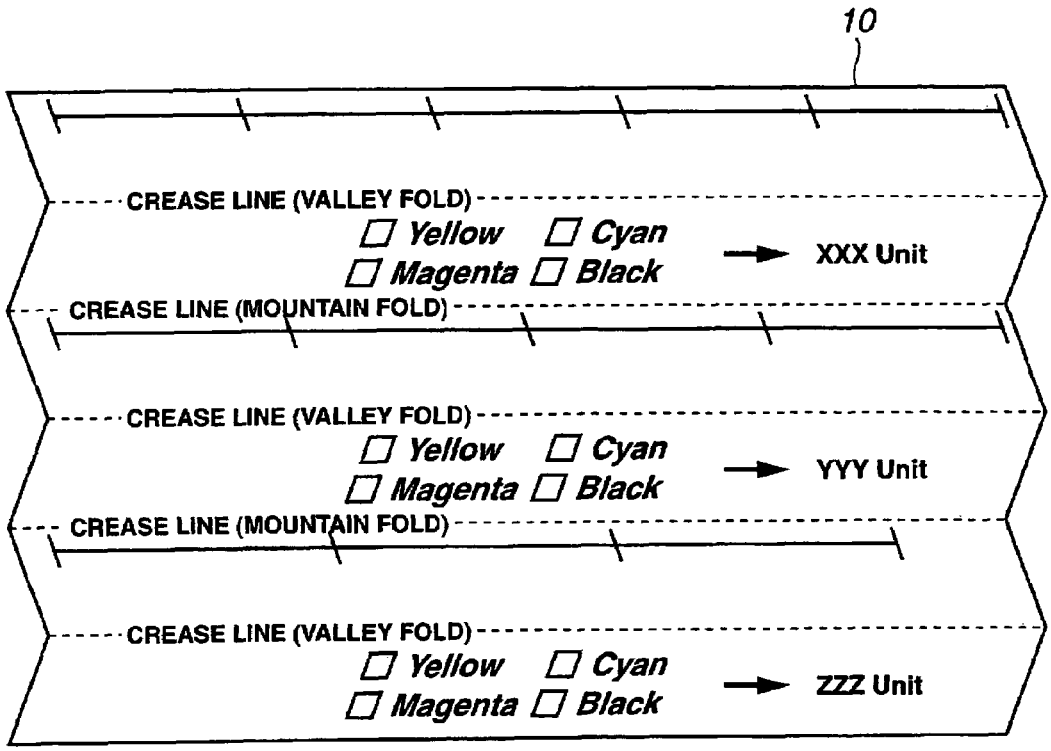
FIG. 5 is a diagram showing an example of a whole of the check sheet formed on a sheet of paper.

FIG. 5 is a diagram showing an example of the whole check sheet 10 in which an image is formed on the sheet of paper.

In the example in FIG. 5, an area of "XXX Unit", an area of "YYY Unit" and an area of "ZZZ Unit" are printed in the check sheet 10. And the crease lines indicating a mountain fold are printed at the boundary between each of the areas of the processing unit, and within each of the areas of the processing unit, the crease lines indicating a valley fold are printed at the boundary between the upper half and the lower half areas. By forming crease lines to the check sheet in accordance with the indication of folding, the check sheet 10 can be folded as shown in FIG. 5.

Figure 6A:
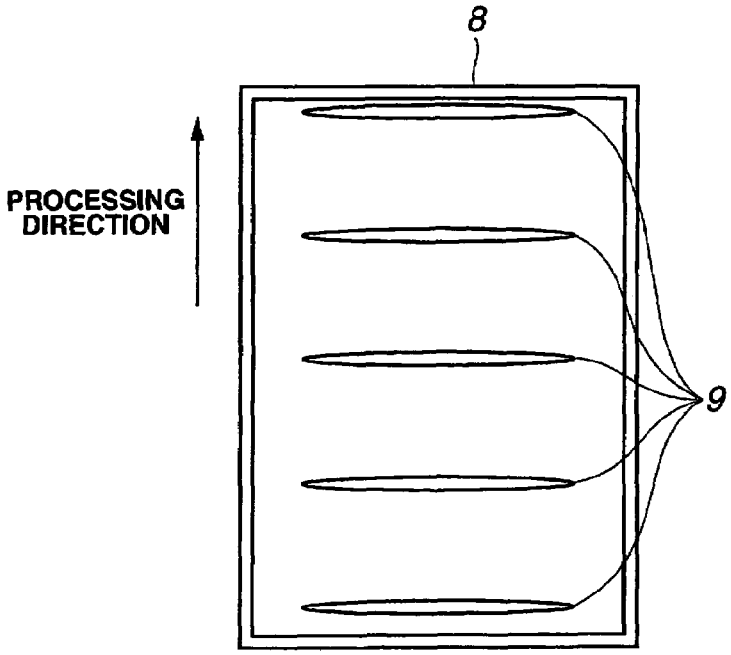
FIGS. 6A and 6B are diagrams showing an example of determining a cause of a problem using a pattern image and a check sheet.
Figure 6B:
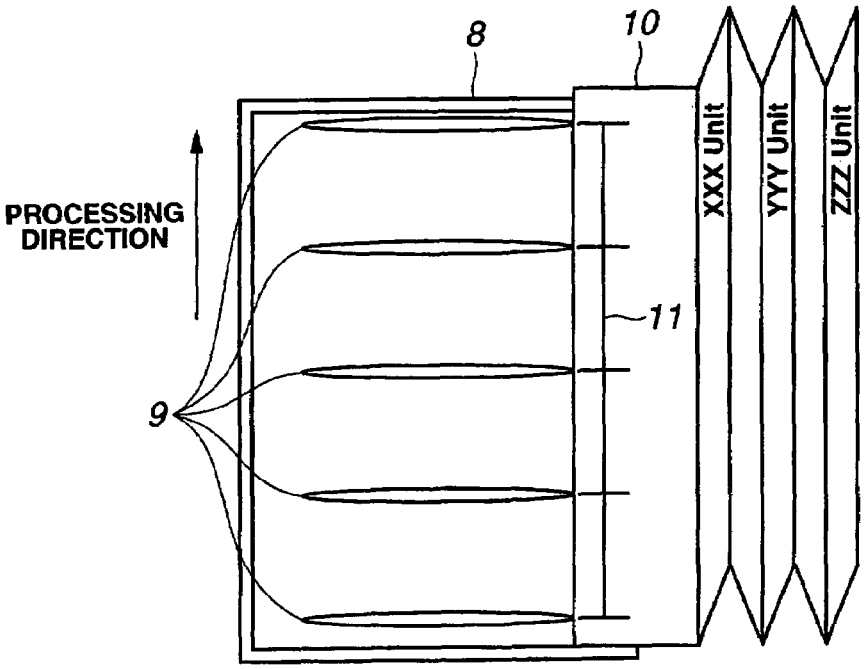

FIGS. 6A and 6B are diagrams showing an example for identifying the cause by using the pattern image 8 and the check sheet 10.

The assumption is made that, as shown in FIG. 6A, the defective print appears on the pattern image 8 with one color (yellow in this example) along the processing direction at a constant interval.

And as shown in FIG. 6B, the check sheet 10 folded as shown in FIG. 5 is set to the pattern image 8. Specifically, the scale 11 formed at the constant interval of "XXX Unit" printed in the area of the processing unit ("XXX Unit" in FIG. 5), in other words, the uppermost area of the folded check sheet, is set to the pattern image so as to check whether the scale 11 is aligned with the pitch of the defective print 9 that appears on the pattern image 8 along the processing direction.

Here, as shown in FIG. 6B, when the scale 11 of "XXX Unit" is aligned with the pitch of the defective print 9, "XXX Unit" can be identified as the processing unit that causes the defective print 9. In this case, by inputting a check to "Yellow" in the check sheet, it is clearer that the cause of the defective print 9 is "XXX Unit" belonging to yellow photoreceptor.

Additionally, when the scale 11 of "XXX Unit" is not aligned with the pitch of the defective print 9, the scale of "YYY Unit" is set to the pitch of the defective print 9. And when the scale 11 is not aligned with the pitch of the defective print, then the scale of "ZZZ Unit" is set to the pitch of the defective print 9 to identify the cause of the defective print 9.

Note that, in this example, the unit name is printed in the unit information printing area 14. However, the target to be printed in the unit information printing area 14 is not limited to the unit name, and a unit number corresponding to the processing unit is also applicable to be printed in the unit information printing area 14. For example, even when a user who attempts to call the support center has little information on the image forming device 1, only by hearing from the user the number corresponding to the scale 11 matching with the pitch of the defective print 9, the technician from the support center can easily understand which processing unit becomes defect based on the number heard from the user.

Additionally, in this example, the inspection printing processing section 6 generates the check sheet 10 based on the inspection data for each of the processing units extracted from the unit inspection data storing section 3. However, in a case that the check sheet is not necessarily formed every time the inspection printing is performed because the inspection data for each of the processing units are fixed values to some extent, it is applicable that, by storing the check sheet 10 in the unit inspection data storing section 3 in advance, the image forming section 7 forms the image of the check sheet 10.

Additionally, in this example, the check sheet 10 is printed out every time the inspection printing is performed. However, the check sheet 10 is not necessarily printed out in such frequency. It is applicable that the check sheet 10 is provided to the image forming device 1 as an attachment, and the check sheet 10 is printed out at a time of loss, damage, or other reasons.

SECOND EXAMPLE

Figure 7:
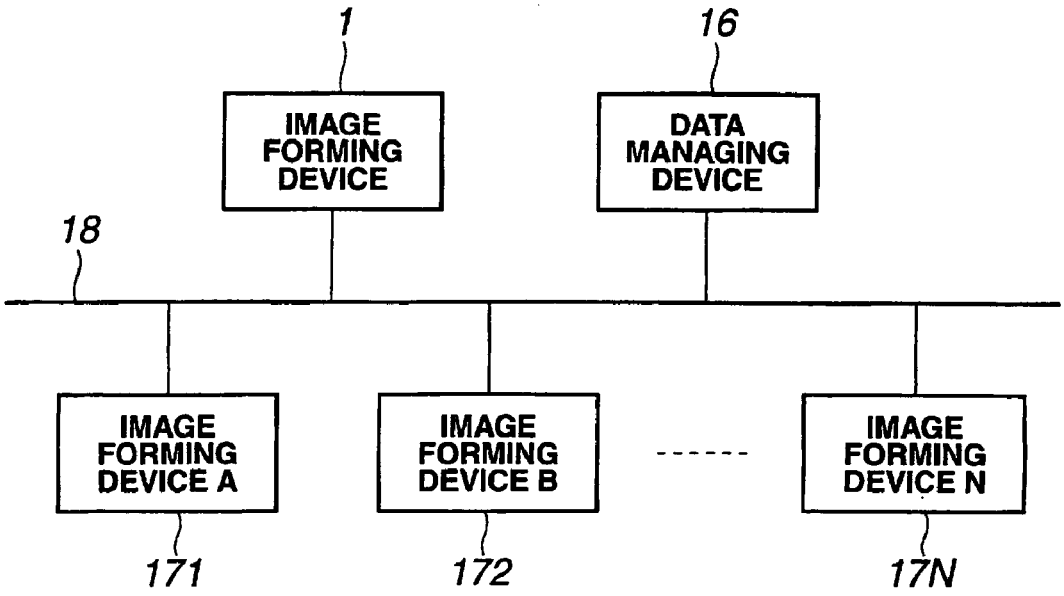
FIG. 7 is a diagram for describing the outline of the second example.

FIG. 7 is a diagram for describing the outline of the second example.

As shown in FIG. 7, the image forming device 1, a data managing device 16, and at least one image forming device (image forming device A 171, image forming device B 172, image forming device N 17N) other than the image forming device 1 are connected each other through the network 18.

In the second example, the description will be made that the inspection printing described in the first example is performed by the operation of the image forming device 1, the data managing device 16, and other image forming devices 171-17N.

Figure 8:
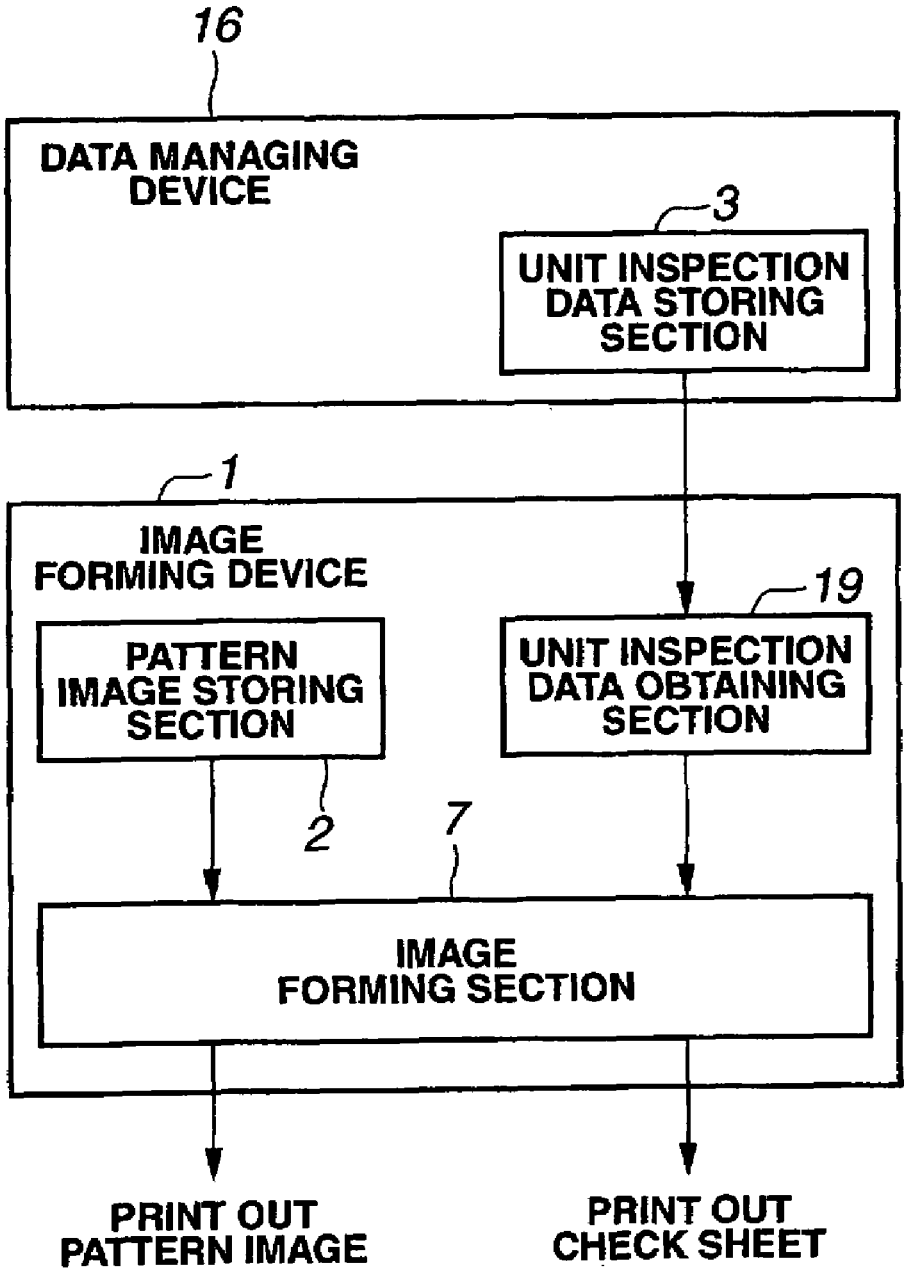
FIG. 8 is a diagram showing an example of a configuration in which the image forming device stores a pattern image, and in which a data managing device stores inspection data for each part.

FIG. 8 is a diagram showing an example in which the image forming device I stores the pattern image and the data managing device 16 stores the unit inspection data.

As shown in FIG. 8, the image forming device 1 includes the pattern image storing section 2 that stores the pattern image, a unit inspection data obtaining section 19 that obtains the unit inspection data from the data managing device 16 at a time of reception of instruction for the inspection printing, the input section for input of the instruction (not shown), the inspection printing reception section that receives the instruction for the inspection printing (not shown), the inspection printing processing section that transfers to the image forming section 7 the check sheet formed based on the pattern image and the unit inspection data obtained by the unit inspection data obtaining section 19 (not shown), the image forming section 7 that forms the pattern image and the check sheet on the sheet of paper. And the data managing device 16 includes the unit inspection data storing section 3 that stores for each of the processing units the constant intervals, as the inspection data, that differ according to the processing units.

As shown in FIG. 8, upon reception of the instruction for inspection printing, the image forming device 1 prints out the pattern image stored therein, and prints out the check sheet by obtaining the unit inspection data stored therein from the data managing device 16.

Figure 9:
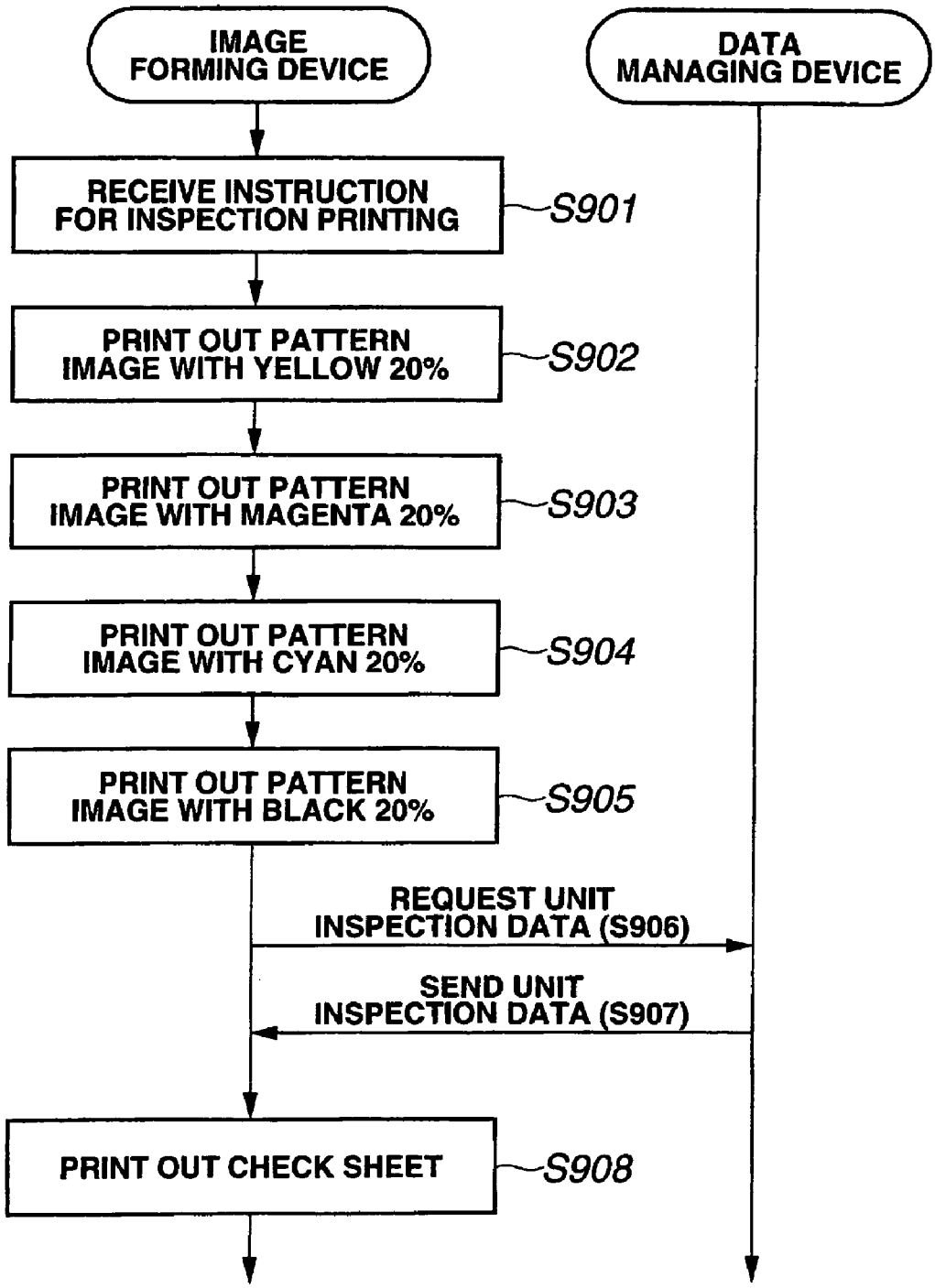
FIG. 9 is a sequence diagram showing a processing flow for inspection printing performed synchronously by the image forming device and the data managing device.

FIG. 9 is a sequence diagram showing a flow of the inspection printing process performed synchronously by the image forming device 1 and the data managing device 16.

When the inspection printing reception section in the image forming device receives the instruction for inspection printing (S901), the inspection printing processing section pulls the pattern image with yellow 20% from the pattern image storing section and the image forming section forms the pattern image with yellow 20% on the sheet of paper (S902), the inspection printing processing section pulls the pattern image with magenta 20% from the pattern image storing section and the image forming section forms the pattern image with magenta 20% on the sheet of paper (S903), the inspection processing section pulls the pattern image with cyan 20% from the pattern image storing section and the image forming section forms the pattern image with cyan 20% on the sheet of paper (S904), the inspection printing processing section pulls the pattern image with black 20% from the pattern image storing section and the image forming section forms the pattern image with black 20% on the sheet of paper (S905), and the unit inspection data obtaining section requests the unit inspection data from the data managing device (S906).

Upon receipt of the request for the unit inspection data from the image forming device, the data managing device sends the unit inspection data stored in the unit inspection data storing section to the image forming device (S907).

After receiving the unit inspection data from the data managing device, the unit inspection data obtaining section in the image forming device generates the check sheet based on the received unit inspection data and the image forming section forms the check sheet on the sheet of paper (S908), and the inspection printing process ends.

Figure 10:
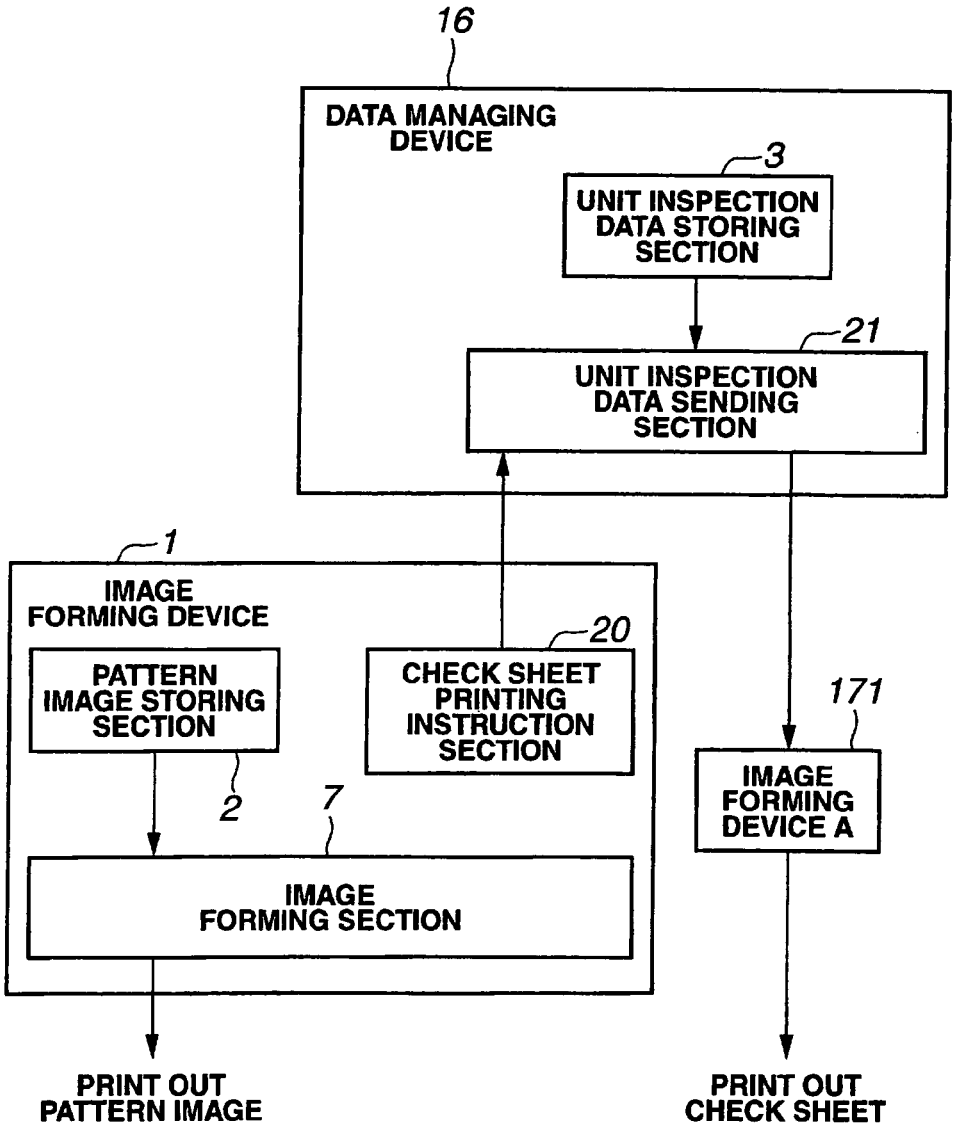
FIG. 10 is a diagram showing an example of a configuration in which the image forming device stores the pattern image, the data managing device stores the inspection data for each part, and an image forming device A, which is another image forming device, prints out the inspection data for each part.

FIG. 10 is a diagram showing an example of a configuration in which the image forming device 1 stores the pattern image and the data managing device 16 storing the unit inspection data, and the image forming device A 171 other than the image forming device 1 prints out the unit inspection data.

As shown in FIG. 10, the image forming device 1 includes the pattern image storing section 2 that stores the pattern image, a check sheet printing instruction section 20 that, upon receipt of the instruction for inspection printing, instructs the data managing device 16 to print out the check sheet, the input section for input of the instruction (not shown), the inspection printing receipt section that receives the instruction for inspection printing (not shown), and the image forming section 7 that forms the pattern image on the sheet of paper. And the data managing device 16 includes the unit inspection data storing section 3 that stores as the inspection data the constant intervals that varies in accordance with the processing units for each of the processing units, and a unit inspection data sending section 21 that, upon receipt of the instruction from the image forming device 1 for printing of check sheets, sends to the image forming device A 171 the unit inspection data stored in the unit inspection data storing section 3 and requests the image forming device A 171 to print out.

As shown in FIG. 10, upon receipt of the instruction for inspection printing, the image forming device 1 prints out the pattern image storing therein, gives the instruction for the data managing device 16 to print out the check sheet. Upon receipt of the instruction from the image forming device 1 to print out the check sheet, the image managing device 16 sends the stored unit inspection data to the image forming device A 171. Upon receipt of the unit inspection data, the image forming device A 171 prints out the check sheet.

Figure 11:
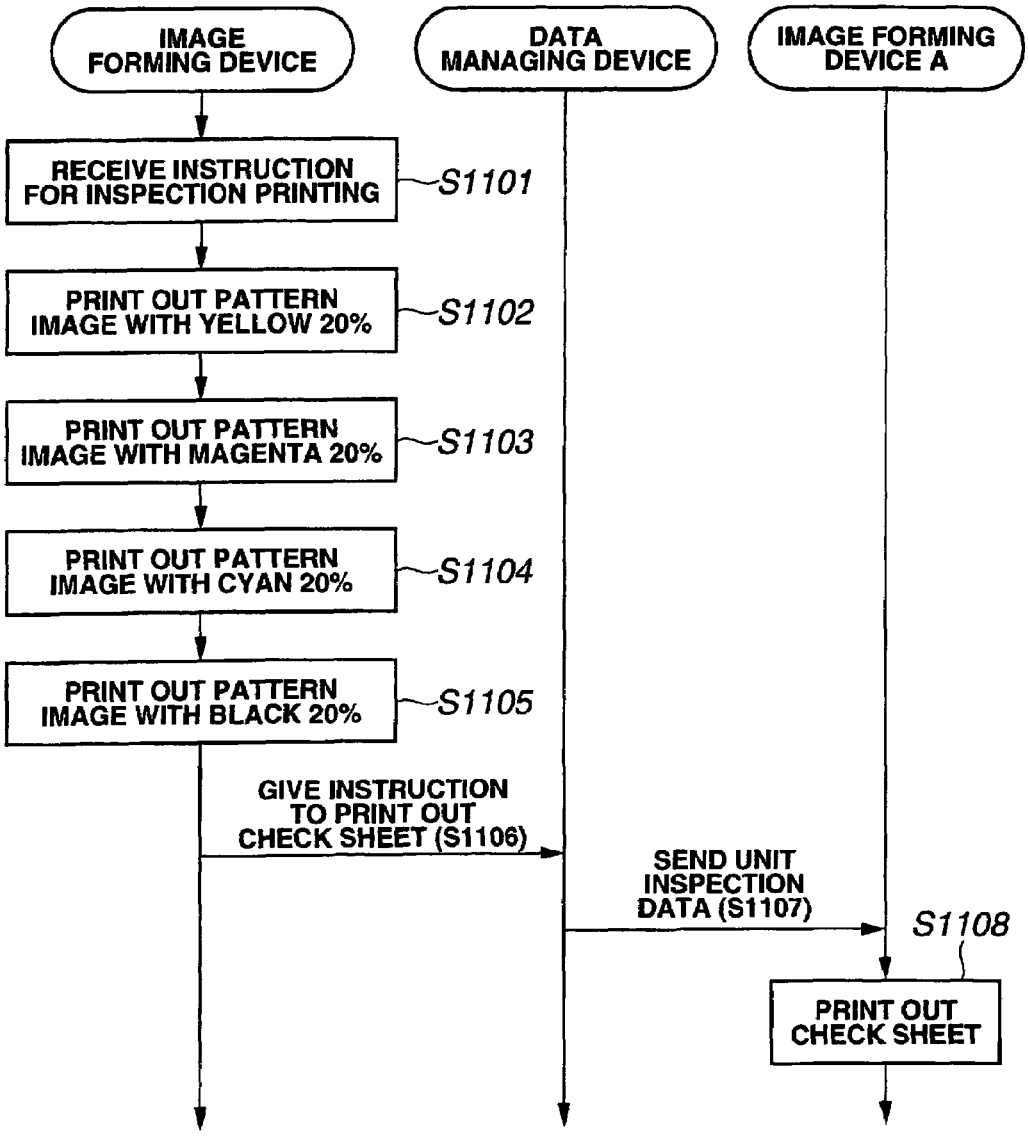
FIG. 11 is a sequence diagram showing a processing flow of inspection printing performed synchronously by the image forming device, the data managing device, and the image forming device A.

FIG. 11 is a sequence diagram showing the flow of the inspection printing process performed synchronously by the image forming device 1, the data managing device 16, and the image forming device A 171.

When the inspection printing reception section in the image forming device receives the instruction for inspection printing (S1101), the inspection printing processing section pulls the pattern image with yellow 20% from the pattern image storing section and the image forming section forms the pattern image with yellow 20% on the sheet of paper (S1102), the inspection printing processing section pulls the pattern image with magenta 20% from the pattern image storing section and the image forming section forms the pattern image with magenta 20% on the sheet of paper (S1103), the inspection printing processing section pulls the pattern image with cyan 20% from the pattern image storing section and the image forming section forms the pattern image with cyan 20% on the sheet of paper (S1104), the inspection printing processing section pulls the pattern image with black 20% from the pattern image storing section and the image forming section forms the pattern image with black 20% on the sheet of paper (S1105), and the check sheet printing instruction section gives the instruction for the data managing device to print out the check sheet (S1106).

Upon receipt of the instruction from the image forming device to print out the check sheet, the data managing device sends to the image forming device A the unit inspection data stored in the unit inspection data section (S1107).

Upon receipt of the unit inspection data from the data managing device, the image managing device A forms the check sheet on the sheet of paper based on the received unit inspection data (S1108), and the inspection printing process ends.

Figure 12:
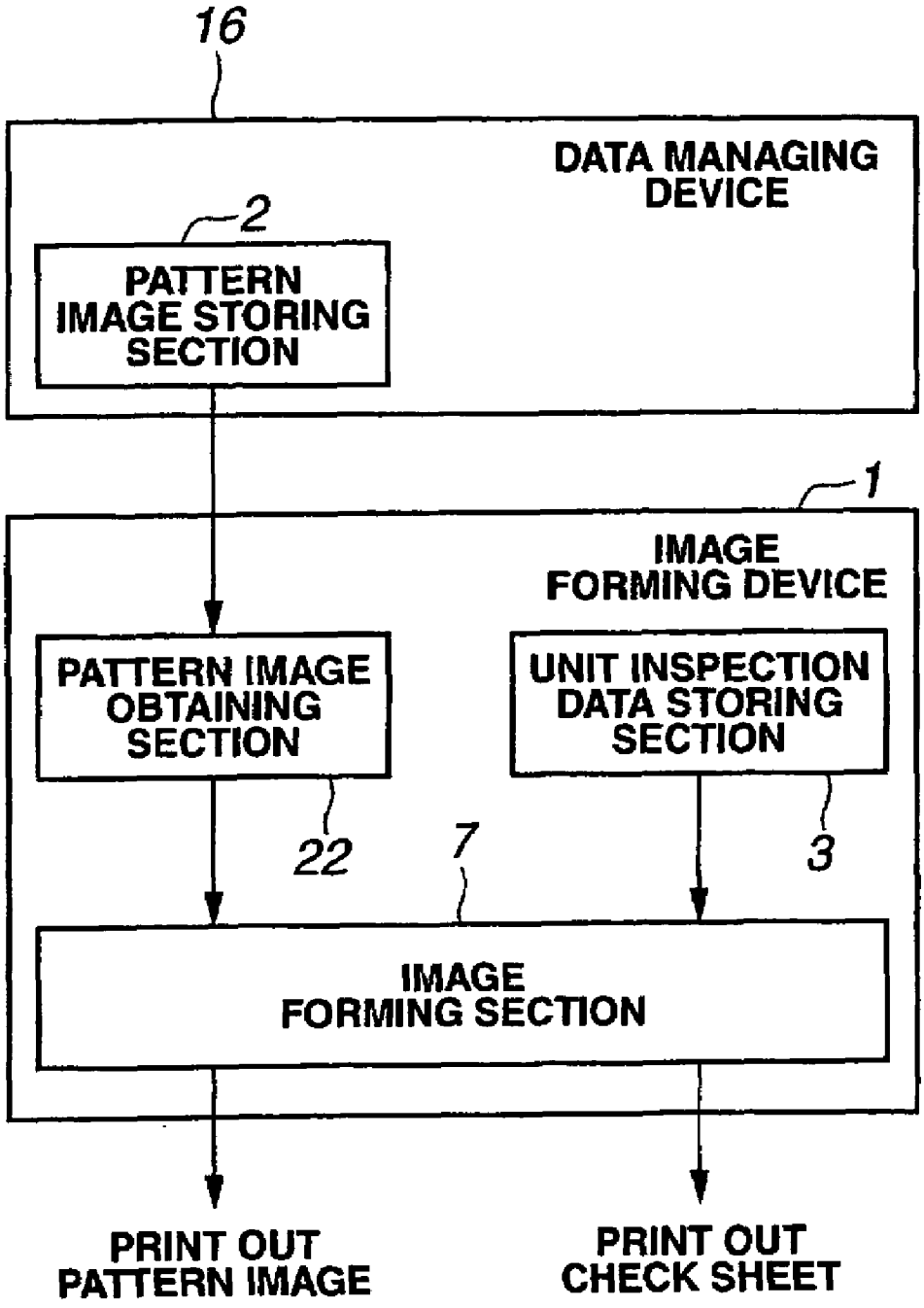
FIG. 12 is a diagram showing an example of a configuration in which the image forming device stores the inspection data for each part, and the data managing device stores the pattern image.

FIG. 12 is a diagram showing an example of a configuration in which the image forming device 1 stores the unit inspection data and the data managing device 16 stores the pattern image.

As shown in FIG. 12, the image forming device 1 includes the unit inspection data storing section 3 that stores as the inspection data the constant intervals that varies in accordance with the processing units for each of the processing units, the pattern image obtaining section 22 that, upon receipt of the instruction for inspection printing, obtains the pattern image from the data managing device 16, the input section for input of the instruction (not shown), the inspection printing receipt section that receives the instruction for inspection printing (not shown), the inspection printing processing section that sends to the image forming section 7 the check sheet generated based on the pattern image obtained by the pattern image obtaining section 22 and the unit inspection data (not shown), the image forming section 7 that forms the pattern image and the check sheet on the sheet of paper. The data managing device 16 includes the pattern image storing section 2 that stores the pattern image.

As shown in FIG. 12, upon receipt of the instruction for inspection printing, the image forming device 1 obtains the pattern image stored in the data managing device 16 to print out the pattern image, and prints out the check sheet based on the unit inspection data stored therein.

Figure 13:
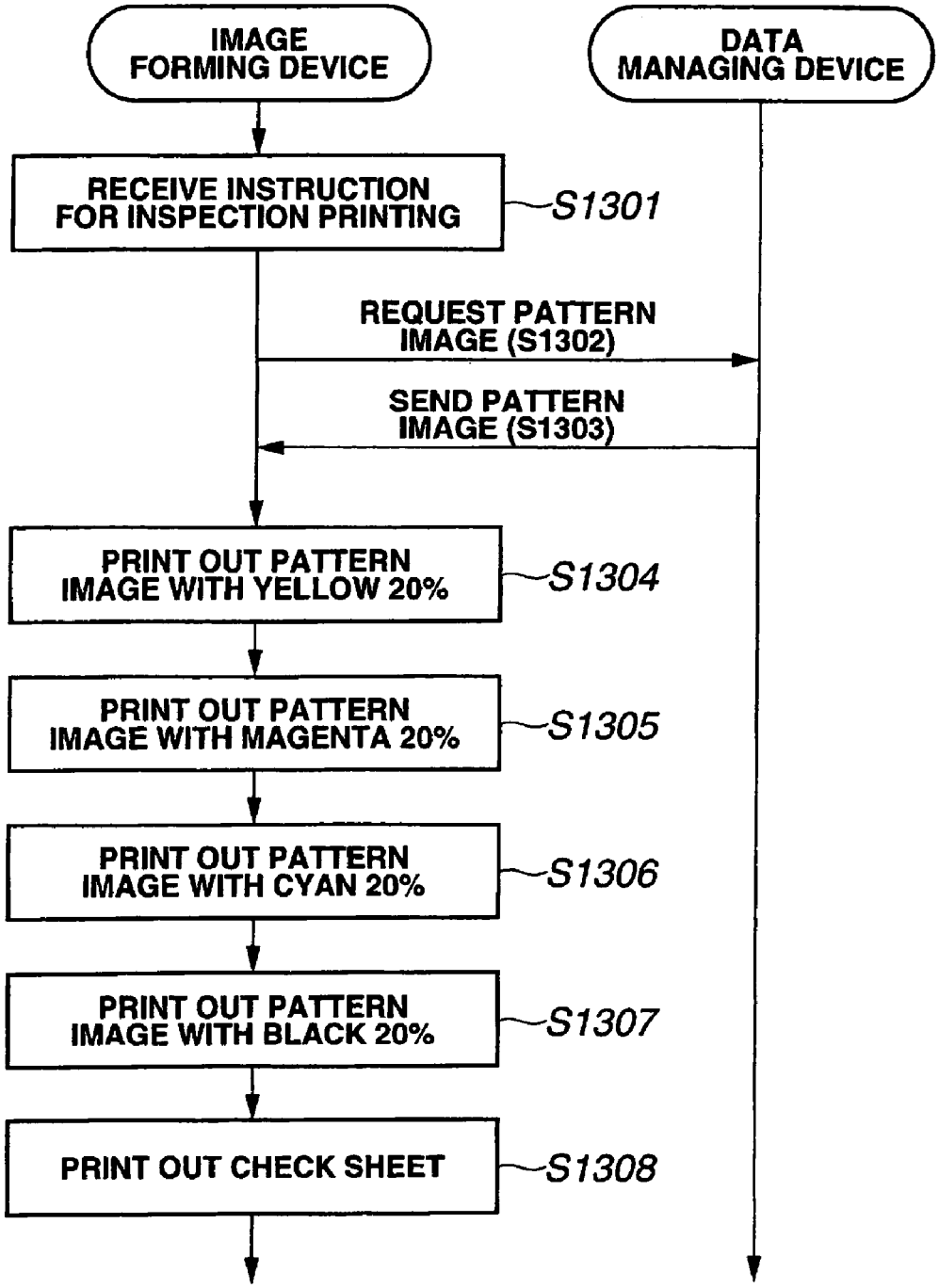
FIG. 13 is a sequence diagram showing a processing flow of inspection printing performed synchronously by the image forming device and the data managing device.

FIG. 13 is a sequence diagram showing a flow of the inspection printing process performed synchronously by the image forming device 1 and the data managing device 16. When the inspection printing reception section in the image forming device receives the instruction for inspection printing (S1301), the pattern image obtaining section requests the pattern image from the data managing device (S1302).

Upon receipt of the request of the pattern image from the image forming device, the data managing device sends to the image forming device the pattern images stored in the pattern image storing section (S1303). When the pattern image obtaining section in the image forming section receives the patter images from the data managing device, the image forming section forms the received pattern image with yellow 20% on the sheet of paper (S1304), the image forming section forms the received pattern image with magenta 20% on the sheet of paper (S1305), the image forming section forms the received pattern image with cyan 20% on the sheet of paper (S1306), and the image forming section forms the received pattern image with black 20% on the sheet of paper (S1307). And the inspection printing processing section pulls the inspection data for each of the processing sections from the unit inspection data storing section and generates the check sheet, the image forming section forms the check sheet on the sheet of paper (S1308), and the inspection printing process ends.

Figure 14:
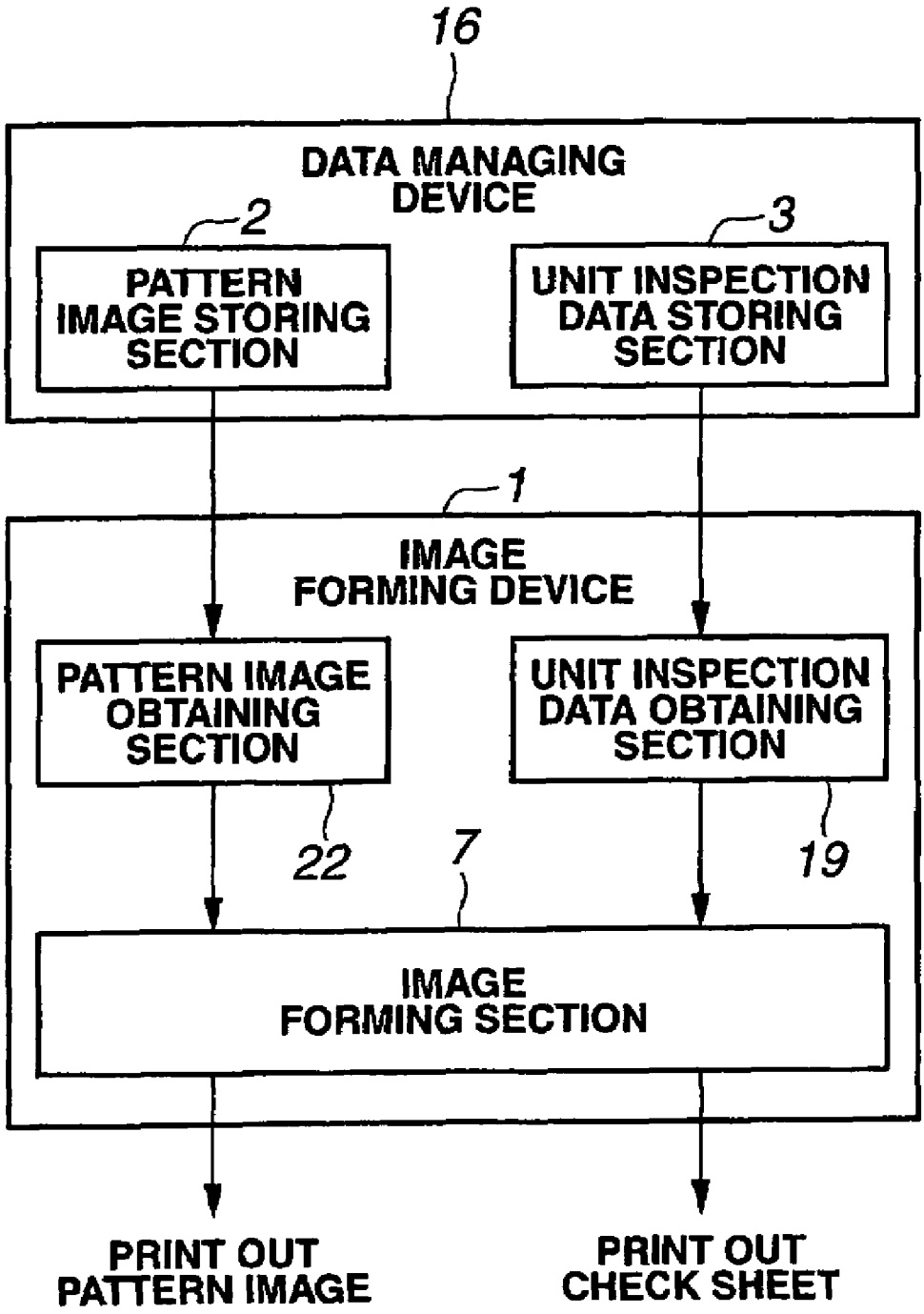
FIG. 14 is a diagram showing a configuration in which the data managing device stores the pattern image and the inspection data for each part.

FIG. 14 is a diagram showing an example of a configuration in which the data managing device 16 stores the pattern images and the unit inspection data.

As shown in FIG. 14, the image forming device 1 includes the pattern image obtaining section 22 that, upon receipt of the instruction for inspection printing, obtains the pattern images from the data managing device 16, the unit inspection data obtaining section 19 that, upon receipt of the instruction for inspection printing, obtains the unit inspection data from the data managing device 16, the input section for input of the instruction (not shown), the inspection printing receipt section that receives the instruction for inspection printing (not shown), the inspection printing processing section that sends to the image forming section 7 the pattern images obtained by the pattern obtaining section 2 and the check sheet generated based on the unit inspection data obtained by the unit inspection data obtaining section 19 (not shown), and the image forming section 7 that forms on the sheet of paper the pattern images and the check sheets. The data managing device 16 includes the pattern image storing section 2 that stores the pattern images, and the unit inspection data storing section 3 that stores as inspection data the constant intervals that varies in according to the processing units for each of the processing units.

As shown in FIG. 14, upon receipt of the instruction for inspection printing, the image forming device 1 obtains and prints out the pattern images stored in the data managing device 16, and obtains the unit inspection data stored in the data managing device 16 to print out the check sheets.

Figure 15:
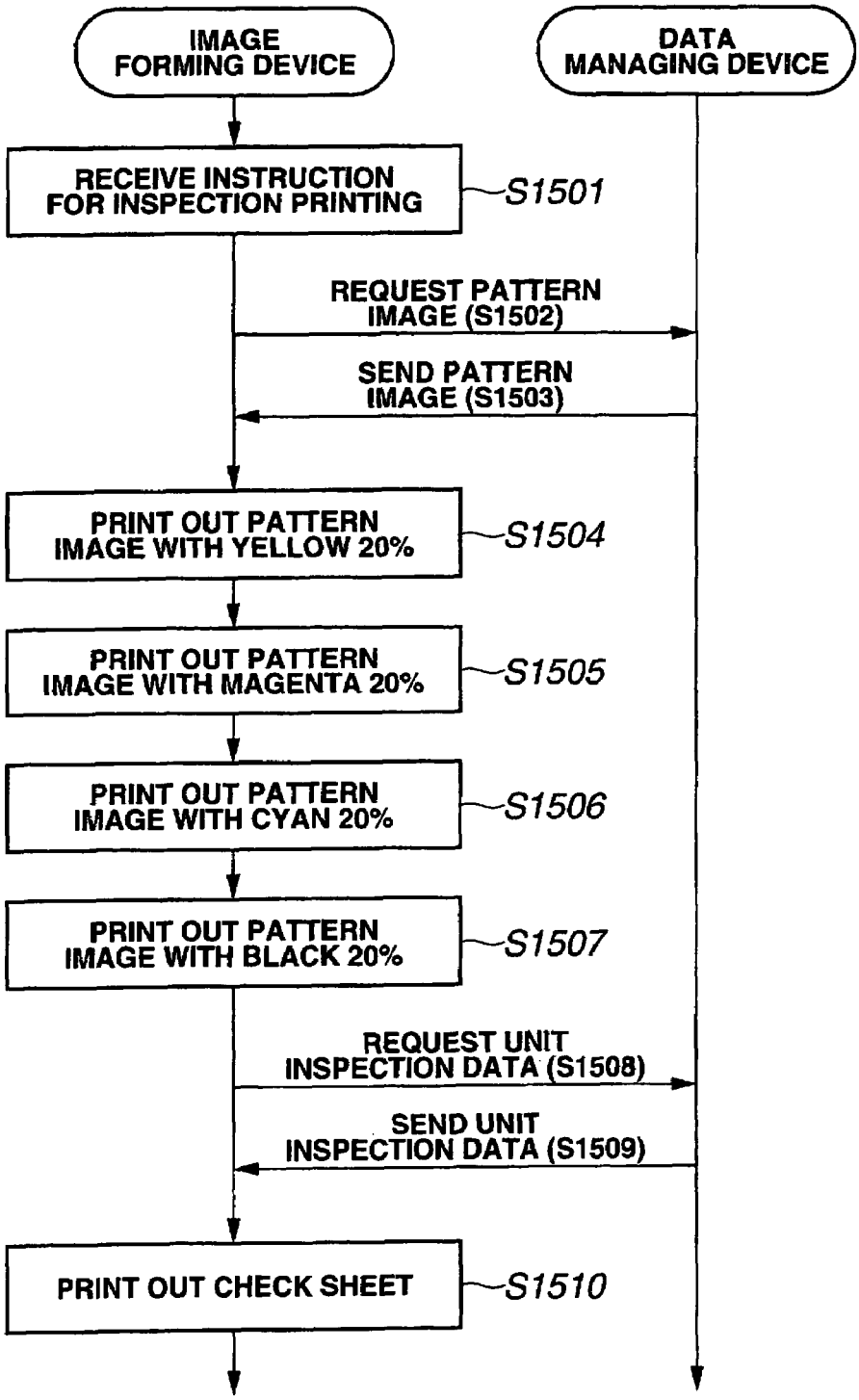
FIG. 15 is a sequence flow showing a processing flow of the inspection printing performed synchronously by the image forming device and the data managing device.

FIG. 15 is a sequence diagram showing a flow of the inspection printing process performed synchronously by the image forming device 1 and the data managing device 16.

When the inspection printing reception section in the image forming device receives the instruction for inspection printing (S1501), the pattern image obtaining section requests the pattern images from the data managing device (S1502).

Upon receipt of the request of the pattern images from the image forming device, the data managing device sends to the image forming device the pattern images stored in the pattern image storing section (S1503). When the pattern image obtaining section in the image forming device receives the pattern images from the data managing device, the image forming section forms: the pattern image with yellow 20% on the sheet of paper (S1504); the pattern image with magenta 20% on the sheet of paper (S1505); the pattern image with cyan 20% on the sheet of paper (S1506); and the pattern image with black 20% on the sheet of paper (S1507). And the unit inspection data obtaining section requests the unit inspection data from the data managing device (S1508). Upon receipt of the request for the unit inspection data from the image forming section, the data managing device sends to the image forming device the unit inspection data stored in the unit inspection data storing section (S1509).

Upon receipt of the unit inspection data from the data managing device, the unit inspection data obtaining section in the image forming device generates the check sheets based on the received unit inspection data, and the data forming section forms the check sheet on the sheet of paper (S1510), and the inspection printing process ends.

Figure 16:
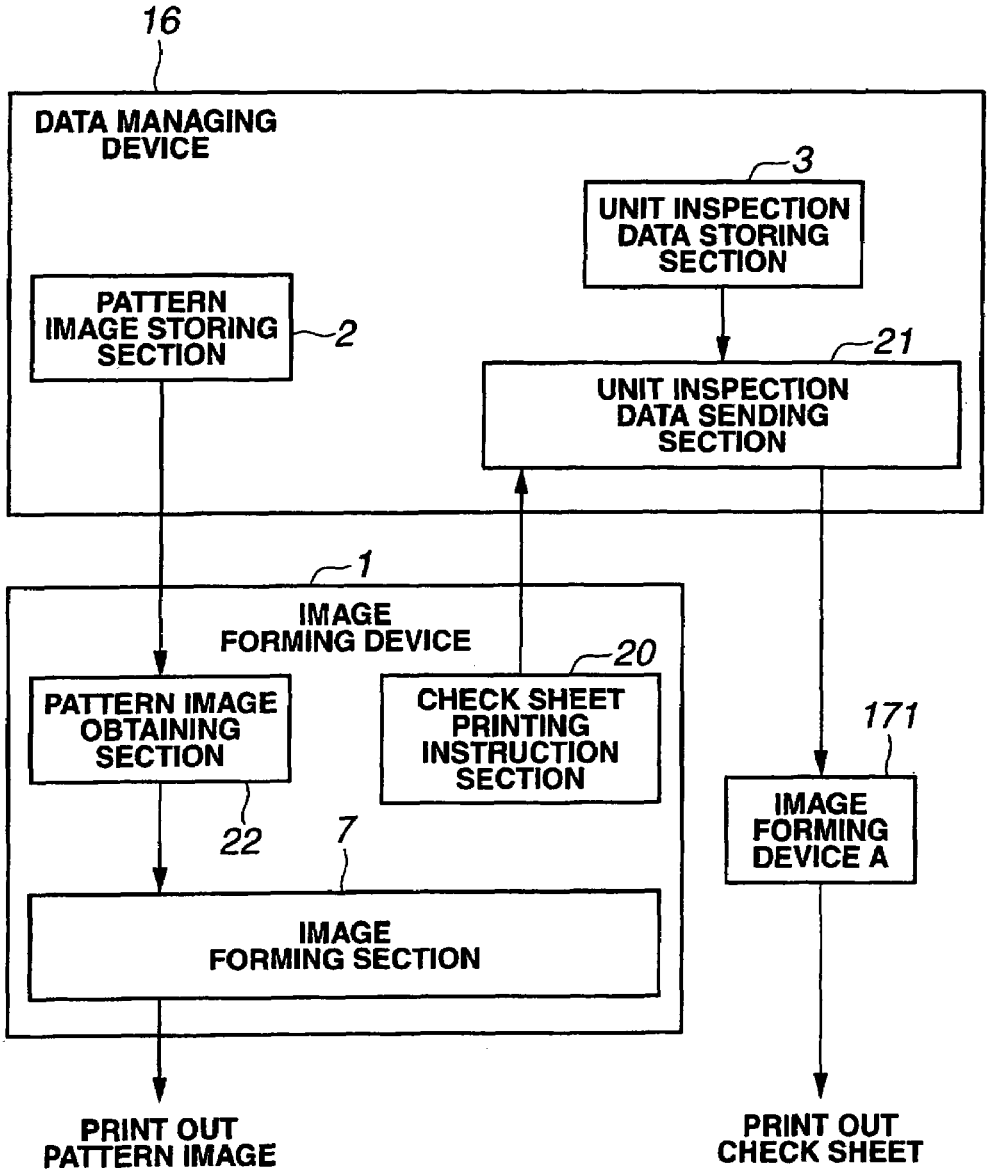
FIG. 16 is a diagram showing an example of a configuration in which the data managing device the pattern image and the inspection data for each part, the image forming device A, which is another image forming device.

FIG. 16 is a diagram showing an example of a configuration in which the data managing device 16 stores the pattern images and the unit inspection data, and the image forming device A 171 other than the image forming device 1 prints out the unit inspection data.

As shown in FIG. 16, the image forming device 1 includes the patter image obtaining section 22 that, upon receipt of the instruction for inspection printing, obtains the pattern image from the data managing device 16, the check sheet printing instruction section 20 that, upon receipt of the instruction for inspection printing, gives to the data managing device 16 the instruction to print out the check sheet, the input section for input of the instruction (not shown), the inspection printing receipt section that receives the instruction for inspection printing (not shown), the inspection printing processing section that sends the pattern images to the image forming section 7 (not shown), and the image forming section 7 that forms the pattern images on the sheet of paper. The data managing device 16 includes the pattern image storing section 2 that stores the pattern images, the unit inspection data storing section 3 that stores as the inspection data the constant intervals that vary in accordance with the processing units for each of the processing units, the unit inspection data sending section 21 that, upon receipt of the instruction from the image forming device 1 to print out the check sheets, sends to the image forming device A 171 the inspection data for each of the units stored in the unit inspection data storing section 3, and the unit inspection data sending section 21 that requests the image forming device A 171 to print out the check sheets.

As shown in FIG. 16, upon receipt of the instruction for inspection printing, the image forming device 1 obtains and prints out the pattern images stored in the data managing device 16, gives the instruction for the data managing device 16 to print out the check sheets. And upon receipt of the instruction from the image forming device 1 to print out the check sheets, the data managing device 16 sends the stored inspection data for each of the units to the image forming device A 171. And, upon receipt of the inspection data for each of the units, the image forming device A 171 prints out the check sheets.

Figure 17:
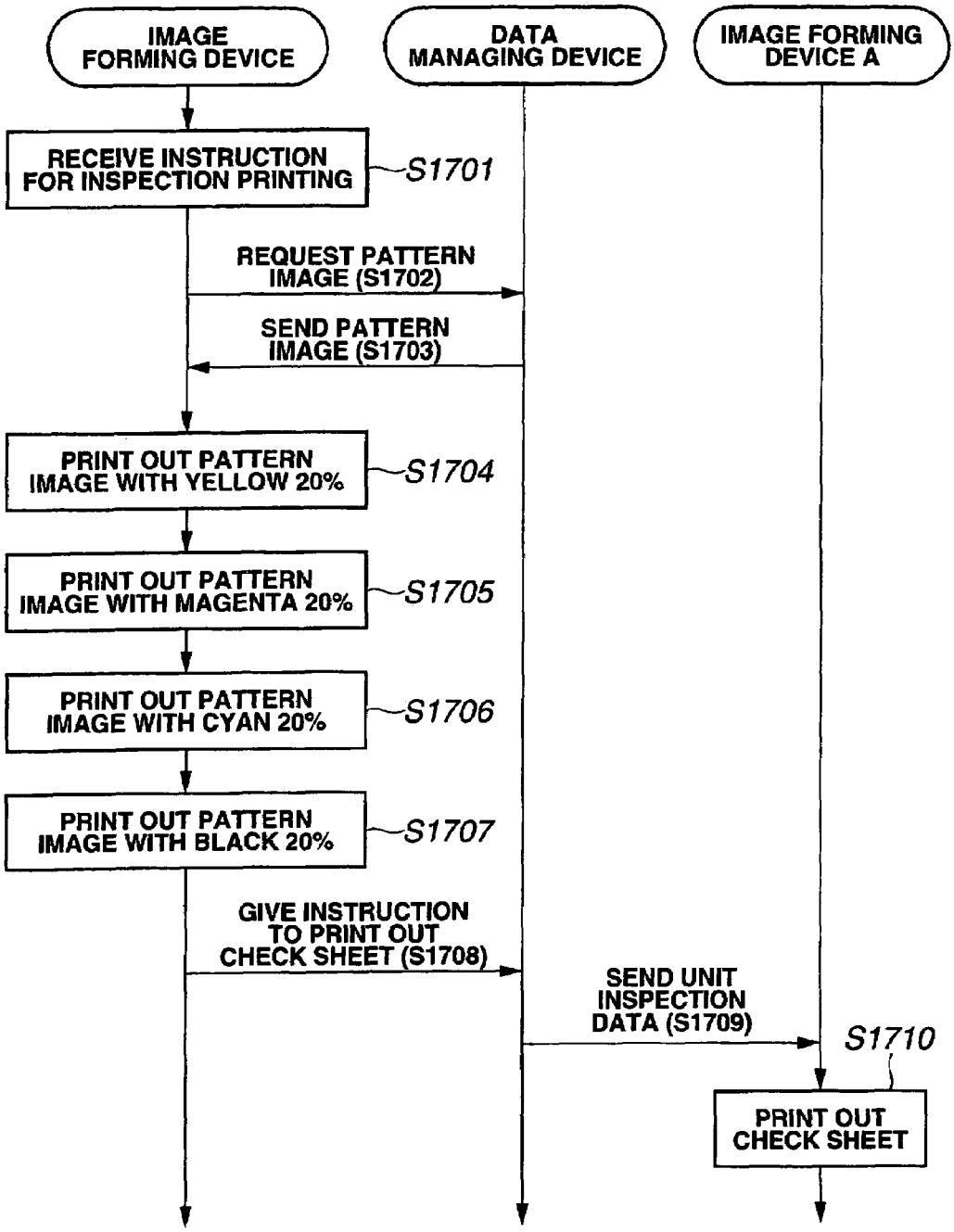
FIG. 17 is sequence diagram showing a processing flow for inspection printing performed synchronously by the image forming device, the data managing device, and the image forming device A.

FIG. 17 is a sequence diagram showing a flow of the inspection printing process performed synchronously by the image forming device 1, the data managing device 16 and the image forming device A 171.

When the inspection printing reception section in the image forming device receives the instruction for inspection printing (S1701), the pattern image obtaining section requests the pattern images from the data managing device (S1702).

Upon receipt of the request of the pattern images from the image forming device, the data managing device sends the pattern image stored in the pattern image storing section to the image forming device (S1703). When the pattern image obtaining section in the image forming device receives the patter images from the data managing device, the image forming section forms: the pattern image with yellow 20% on the sheet of paper (S1704); the pattern image with magenta 20% on the sheet of paper (S1705); the pattern image with cyan 20% on the sheet of paper (S1706); and the pattern image with black 20% on the sheet of paper (S1707). And the check sheet printing instruction section gives the instruction for the data managing device to print out the check sheet (S1708).

Upon receipt of the instruction from the image forming device to print out the check sheets, the data managing device sends the inspection data for each of the units stored in the unit inspection data storing section to the image forming device A (S1709).

Upon receipt of the inspection data for each of the units from the data managing device, the image forming device A forms the check sheet on the sheet of paper based on the received inspection data for each of the units (S1710), and the inspection printing process ends.

Note that, in this example, the image forming device 1 starts the inspection printing process after the image forming device receives the instruction for inspection printing. However, the inspection printing process is not limited to be started after the receipt by the image forming device. It is also applicable that the image forming device starts the inspection printing process after the data managing device 16 receives the instruction for inspection printing.

Additionally, since the way for identifying the cause using the pattern images and the check sheets is similar to the way described in the first example, the description thereof is omitted in this example.

Additionally, in this example, the inspection printing processing section generates the check sheets based on the inspection data for each of the units. However, in a case that it is not necessary to generate the check sheets every time the inspection printing is made because the inspection data for each of the units are fixed values to some extent, it is applicable that, by storing the images of the check sheet in the unit inspection data storing section 3 in advance, the image forming section 7 generates the images of the check sheet.

Additionally, in this example, the check sheet is printed out every time the inspection printing is performed. However, the check sheet is not necessarily printed out in such frequency. It is also applicable that the check sheet 10 is provided to the image forming device 1 as an attachment, and the check sheet 10 is printed out at a time of loss, damage, or other reasons.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming device, comprising:

an inspection data storing section that stores inspection data for inspecting an inspection target for identifying a cause of a defective print, and an image forming section that forms on a medium the inspection data stored in the inspection data storing section, wherein the inspection data includes a cause identifying standard for identifying a defective unit that causes the defective print, and information regarding a unit to be identified as the defective unit; and the cause identifying standard is an occurrence interval of the defective print affected by the defective unit.

2. The image forming device according to claim 1, further comprising:

an inspection target data storing section that stores inspection target data to be inspected for identifying the cause of the defective print, wherein the image forming section forms on the medium the inspection target data stored in the inspection target data storing section.

3. The image forming device according to claim 1, wherein the cause identifying standard and the information are formed on the medium within an area set for each unit, and information indicating a boundary of the area set for each of the unit is formed on the medium.

4. The image forming device according to claim 2, wherein the inspection target data is a pattern image with one color solidly colored in a formable area on the medium, and the inspection target data storing section stores the pattern image with at least one color.

5. A medium, comprising:

an area in which a cause identifying standard for identifying a defective unit that causes a defective print is formed, and an area in which information regarding a unit to be identified as the defective unit, wherein the cause identifying standard and the information are formed within an area set for each unit, and information indicating a boundary of the area set for each of the unit is formed.

6. The medium according to claim 5, wherein the cause identifying standard is an occurrence interval of the defective print affected by the defective unit.

7. An inspection system, comprising:

an image forming device and a data managing device, each of which is connected through a communication section, and the data managing device including:

an inspection data storing section that stores inspection data for inspecting an inspection target for identifying a cause of a defective print, and the image forming device including:

an inspection data obtaining section that obtains the inspection data from the data managing device, and an image forming section that forms on a medium the inspection data obtained by the inspection data obtaining section, wherein the inspection data includes a cause identifying standard for identifying a defective unit that causes the defective print, and information regarding a unit to be identified as the defective unit, and the cause identifying standard is an occurrence interval of the defective print affected by the defective unit.

8. The inspection system according to claim 7, wherein the image forming device further comprises an inspection target data storing section that stores inspection target data to be inspected for identifying the cause of the defective print, wherein the image forming section forms on the medium the inspection target data stored in the inspection target data storing section.

9. The inspection system according to claim 8, wherein the inspection target data is a pattern image with one color solidly colored in a formable area on the medium, and the inspection target data storing section stores the pattern image with at least one color.

10. The inspection system according to claim 7, wherein the data managing device further comprises an inspection target data storing section that stores the inspection target data to be inspected for identifying the cause of the defective print, and the image forming device further comprises an inspection target data obtaining section that obtains the inspection target data from the data managing device, wherein the image forming section forms on the medium the inspection target data obtained by the inspection target data obtaining section.

11. The inspection system according to claim 10, wherein the inspection target data is a pattern image with one color solidly colored in a formable area on the medium, and the inspection target data storing section stores the pattern image with at least one color.

12. The inspection system according to claim 7, wherein the cause identifying standard and the information are formed on the medium within an area set for each unit, and information indicating a boundary of the area set for each of the unit is formed.

13. An inspection system, comprising: an image forming device, a data managing device, and other image forming device other than the image forming device, each of which is connected through a communication section, and the data managing device including:

an inspection data storing section that stores inspection data for inspecting an inspection target for identifying a cause of a defective print, and a transmission section that transmits to the other image forming device the inspection data stored in the inspection data storing section, the image forming device including:

an instruction section that instructs the data managing device to form the inspection data on a medium, the transmission section transmitting to the other image forming device the inspection data when the image forming device instructs to form the inspection data on the medium, and the other image forming device forming on the medium the inspection data transmitted from the data managing device, wherein the data managing device further comprises an inspection target data storing section that stores inspection target data to be inspected for identifying the cause of the defective print, the image forming device further comprises an inspection target data obtaining section that obtains the inspection target data from the data managing device, and the image forming section forms on the medium the inspection target data obtained by the inspection target data obtaining section.

14. The inspection system according to claim 13, wherein the inspection target data is a pattern image with one color solidly colored within a formable area on the medium, and the inspection target data storing section stores the pattern image with at least one color.

15. An inspection system, comprising: an image forming device, a data managing device, and other image forming device other than the image forming device, each of which is connected through a communication section, and the data managing device including:

an inspection data storing section that stores inspection data for inspecting an inspection target for identifying a cause of a defective print, and a transmission section that transmits to the other image forming device the inspection data stored in the inspection data storing section, the image forming device including:

an instruction section that instructs the data managing device to form the inspection data on a medium, the transmission section transmitting to the other image forming device the inspection data when the image forming device instructs to form the inspection data on the medium, and the other image forming device forming on the medium the inspection data transmitted from the data managing device, wherein the inspection data includes a cause identifying standard for identifying a defective unit that causes the defective print, and information regarding a unit to be identified as the defective unit.

16. The inspection system according to claim 15, wherein the image forming device further comprises an inspection target data storing section that stores inspection target data to be inspected for identifying the cause of the defective print, and the image forming section forms on the medium the inspection target data stored in the inspection target data storing section.

17. The inspection system according to claim 16, wherein the inspection target data is a pattern image with one color solidly colored within a formable area on the medium, and the inspection target data storing section stores the pattern image with at least one color.

18. The inspection system according to claim 15, wherein the cause identifying standard is an occurrence interval of the defective print on the medium affected by the defective unit.

19. The inspection system according to claim 15, wherein the cause identifying standard and the information are formed on the medium within an area set for each unit, and information indicating a boundary of the area set for each of the unit is formed on the medium.

20. An inspection system, comprising: an image forming device and a data managing device, each of which is connected through a communication section, and the data managing device including:

an inspection target data storing section that stores inspection target data to be inspected for identifying a cause of a defective print, and the image forming device including:

an inspection data storing section that stores inspection data for inspecting an inspection target for identifying the cause of the defective print, an inspection target data obtaining section that obtains the inspection target data from the data managing device, and an image forming section that forms on a medium the inspection data stored in the inspection data storing section and the inspection target data obtained by the inspection target data obtaining section, wherein the inspection data includes a cause identifying standard for identifying a defective unit that causes the defective print, and information regarding a unit to be identified as the defective unit; and the cause identifying standard is an occurrence interval of the defective print on the medium affected by the defective unit.

21. The inspection system according to claim 20, wherein the cause identifying standard and the information are formed on the medium within an area set for each unit, and information indicating a boundary of the area set for each of the unit is formed on the medium.

22. The inspection system according to claim 20, wherein the inspection target data is a pattern image with one color solidly colored within a formable area on the medium, and the inspection target data storing section stores the pattern image with at least one color.

23. A computer readable recording medium storing an inspection program causing an image forming device to execute a process, the process comprising:

performing an inspection data image forming process for forming, on a medium, inspection data for inspecting an inspection target for identifying a cause of a defective print, wherein the inspection data includes a cause identifying standard for identifying a defective unit that causes the defective print, and information regarding a unit to be identified as the defective unit; and the cause identifying standard and the information are formed on the medium within an area set for each unit, and information indicating a boundary of the area set for each of the unit is formed on the medium.

24. The computer readable recording medium according to claim 23, wherein the processing comprises:

performing an inspection target data image forming process for forming, on the medium, inspection target data to be inspected for identifying the cause of the defective print.

25. The computer readable recording medium according to claim 24, wherein the inspection target data is a pattern image with one color solidly colored in a formable area on the medium, and the pattern image with at least one color is stored as the inspection target data.

26. The computer readable recording medium according to claim 23, wherein the cause identifying standard is an occurrence interval of the defective print on the medium affected by the defective unit.

* * * * *